US008381919B2

(12) United States Patent
Amaral et al.

(10) Patent No.: US 8,381,919 B2
(45) Date of Patent: Feb. 26, 2013

(54) STORING DEVICE FOR A DISHWASHING MACHINE

(75) Inventors: Henrique Amaral, Furth (DE); Stefan Westergard, Stockholm (SE); Hartmut Hofmann, Udine (IT); Daniela Salmaso, Pordenone (IT); Lizandro Chrestenzen, Curitaba (BR); Luigi Salerno, Cinesello Balsamo (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 12/346,001

(22) Filed: Dec. 30, 2008

(65) Prior Publication Data

US 2009/0301977 A1 Dec. 10, 2009

Related U.S. Application Data

(63) Continuation of application No. 12/092,889, filed as application No. PCT/EP2006/010846 on Nov. 13, 2006, now abandoned.

(30) Foreign Application Priority Data

Nov. 16, 2005 (EP) ..... 05024985

(51) Int. Cl.
*A47G 19/08* (2006.01)

(52) U.S. Cl. ..... 211/41.9

(58) Field of Classification Search ..... 211/41.8, 211/41.9, 85.13, 85.18, 183; 206/563, 438; 422/297, 300

See application file for complete search history.

(56) References Cited

U.S. PATENT DOCUMENTS

| | | | | |
|---|---|---|---|---|
| 3,025,864 | A | 3/1962 | Ensign | |
| 3,266,632 | A * | 8/1966 | Maslow | 211/41.8 |
| 3,289,683 | A | 12/1966 | Tomlin | |
| 3,433,363 | A * | 3/1969 | Clearman et al. | 211/41.8 |
| 3,605,166 | A * | 9/1971 | Chen | 15/215 |
| 4,593,822 | A | 6/1986 | Yeaney et al. | |
| 4,798,292 | A * | 1/1989 | Hauze | 206/439 |
| 4,917,248 | A | 4/1990 | Friskney | |
| 5,098,676 | A * | 3/1992 | Brooks, Jr. | 422/292 |
| 5,211,915 | A * | 5/1993 | Monch | 422/102 |
| 5,407,648 | A * | 4/1995 | Allen et al. | 422/297 |
| 5,518,126 | A * | 5/1996 | Davis | 211/41.8 |
| 5,681,539 | A * | 10/1997 | Riley | 422/300 |
| 5,766,561 | A * | 6/1998 | Frieze et al. | 422/297 |
| 6,048,504 | A | 4/2000 | Riley | |
| 6,244,447 | B1 * | 6/2001 | Frieze et al. | 211/85.13 |
| 6,572,819 | B1 * | 6/2003 | Wu et al. | 422/28 |
| 7,601,312 | B2 * | 10/2009 | Riley et al. | 422/300 |
| 2007/0017885 | A1 * | 1/2007 | Taike et al. | 211/85.13 |

FOREIGN PATENT DOCUMENTS

| | | |
|---|---|---|
| DE | 2755892 | 12/1977 |
| DE | 2946591 | 11/1979 |

(Continued)

OTHER PUBLICATIONS

International Search Report for PCT/EP2006/010846, dated Feb. 13, 2007, 2 pages.

*Primary Examiner* — Jennifer E. Novosad
(74) *Attorney, Agent, or Firm* — Pearne & Gordon LLP

(57) ABSTRACT

Provided is a mat device to be arranged in a basket of a dishwashing machine. The mat device includes a base structure including a rigid supporting structure and a flexible structure allowing the base structure to be at least partially conformed to a bottom of the basket. The base structure is at least partially covered by an elastic material, supports a flexible structure for receiving dishes or cutlery, or is at least partially covered by the elastic material and supports the flexible structure for receiving the dishes or cutlery.

18 Claims, 1 Drawing Sheet

FOREIGN PATENT DOCUMENTS

Figure 1:
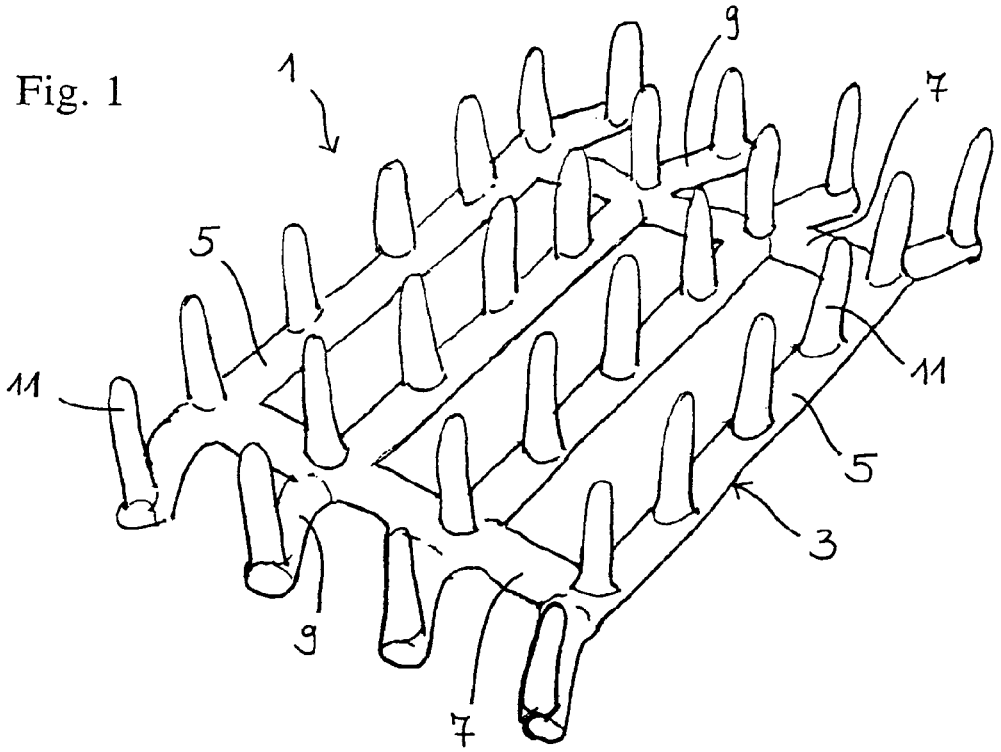

| | | |
|---|---|---|
| DE | 20304305 | 6/2003 |
| DE | 10311888 | 10/2004 |
| FR | 2021050 | 7/1970 |
| JP | 9285435 | 11/1997 |
| JP | 11332809 | 12/1999 |
| JP | 2003190071 | 7/2003 |

* cited by examiner

STORING DEVICE FOR A DISHWASHING MACHINE

CROSS-REFERENCE TO RELATED APPLICATIONS

This application is a continuation of U.S. application Ser. No. 12/092,889, filed on May 7, 2008 which is a 371 international of PCT/EP2006/010846 filed Nov. 13, 2006 which claims the benefit of European application Serial No. 05024985.3, filed on Nov. 16, 2005. These applications are incorporated herein by reference.

The present invention relates to an auxiliary storing device or soft pad for storing small to medium sized cutlery, dishes and/or glassware in or on a basket of a dishwashing machine.

In a conventional dishwashing machine cutlery is stored in a cutlery basket placed in the lower basket of the dishwashing machine or on a separate tray formed as top drawer of the dishwashing machine. Delicate glassware is stored on inclined glass supports at the upper basket. When loading cutlery, dishes and glassware into the dishwashing machine, the individual parts are sorted and placed at the convenient position or compartment of the dishwashing machine.

It is an object of the invention to provide an auxiliary storing device for a basket of a dishwashing machine which provides a conventional basket with a quick access loading zone.

The invention is defined in the claims.

Particular embodiments are set out in the dependent claims.

For normal loading processes for loading cutlery and dishes into a dishwashing machine the user needs some time to sort the cutlery and dishes and to place them at the appropriate location on the upper or lower basket, for example cutlery in the cutlery basket on the lower basket, glasses on glass supports at the side of the upper basket, and small and large plates in the corresponding plate inserts in the lower or upper basket. This is alright, when the user has enough time and when all users take care while loading. Time however is sometimes limited and last minute placements are then not made so carefully. In particular small children only partially open the dishwashing machine, partially draw out the upper basket and place their dishes anywhere in the front region of the basket. The invention provides a mat device or flexible or soft coated shelf having a quick access zone for last minute loading of the dishwashing machine. In the present context, a dish or dishes which can be placed on the auxiliary storing device of the invention preferably comprise(s) any plate, bowl, cup, pot, jug, pitcher, vase etc. which is made from any suitable material such as e.g china, earthenware, any plastics material or the like, as well as glassware of any kind which can be places on the auxiliary storing device of the invention such as e. g. a drinking glass of any kind, a glass plate, glass bowl, glass cup, glass pot, glass jug, glass pitcher, glass vase etc.

According to claim 1, a flexible mat device or soft pad is provided which can be arranged in a basket of a dishwashing machine, preferentially on the bottom of the basket. The flexible mat device has a base structure adapting at least in part flexibly or elastically to the contour of the bottom of the basket or to the contour of the place in the basket where the flexible mat device is placed. Depending on the need, the flexible mat device may be placed into the basket or removed from it. Due to its flexibility and in consequence due to its at least partial adaptation to the contour of the basket, the flexible mat device can be placed nearly at all desired portions within the basket, and on the other hand the volume required within the basket for placing the mat device is minimal. When it is removed, the flexible mat device may be bent, e.g. folded or rolled and stored outside the dishwashing machine with minimum storing volume requirements. Due to its flexibility the flexible mat device is at least partially elastic, so that it is bent, e. g. it gives way elastically, when cutlery or dishes are placed on top of the flexible mat device preventing damage to delicate dishes e.g. delicate glassware or additionally adapting to the form of the cutlery or dishes placed on the flexible mat device resulting in an improved support within the basket.

In a preferred embodiment, the flexible mat device is made of an elastic material or it is at least partially coated with an elastic material, in particular with a soft material, such that damages dishes, e.g. glassware are further reduced. Also lateral movements on the flexible mat device are inhibited while the basket is drawn out of or pushed into the dishwashing machine. In particular, if dishes or cutlery are loaded in last minute in a rush movement the dropping of the dishes is dampened thereby avoiding mechanical stress to the dishes. Further, the generation of noise while loading/unloading the dishes or cutlery and during the dishwashing program or the movement of the basket is reduced.

According to claim 2, a mat device is provided similar to the above mentioned flexible mat device, in which however at least partially a rigid supporting structure is provided. The supporting structure is at least partially covered by an elastic material in particular a soft material and/or a flexible structure in particular a soft flexible structure is attached thereto on which dishes or cutlery can be placed. The rigid supporting structure, which at least partially forms the base of the mat device, can at least partially bridge or span steps or unevenness in a basket of a dishwashing machine. For example one end of the mat device may be placed against a side wall of the basket, while the other end rests on the bottom of the basket. Then the mat device is inclined within the basket and the dishes or cutlery are placed on the soft elastic material or on the flexible structure in the quick access zone of the mat device. In an embodiment, rigid supporting structure portions of the mat device are linked with flexible connection elements, such that also the mat device having a rigid supporting structure may be bent and partially adapted to the contour of the basket, depending on its orientation within the basket.

It should be noted that the soft pad, i.e. the mat device and the flexible mat device of the invention may also be used as a shelf or as a supporting pad either of which provides the function of supporting dishes and cutlery and may optionally be placed within a basket of a conventional dishwashing machine at the desired location. In the following, when mentioning 'mat device', reference is normally made to the flexible mat device as well as to the mat device, unless otherwise indicated.

In a preferred embodiment a met device comprises a flexible structure which comprises a plurality of supporting elements such as pins which are protruding from the base structure of the mat device of the invention and give an additional support for the cutlery and/or dishes placed on the mat device. Preferentially, the supporting elements are flexible or elastic, such that they are bent, when dishes like cups are placed on the mat device, thereby improving the mechanical stability of the placed goods. In a preferred embodiment, the supporting elements are made of two components, a soft component for example on the surface on which the goods are placed, and a rigid component on the bottom side or in the core of the supporting elements. Additionally or alternatively the supporting elements may be made of a semi-rigid material. In this case, the supporting elements are partially bent to a certain degree resulting in an adaptation to the contour of the goods placed on the mat device, while the semi-rigid supporting elements themselves exert a counter force onto the placed good.

In a further preferred embodiment, the supporting elements are at least partially hollow, such that their flexibility is improved. On the other hand, the mat device may be positioned onto a pin, for example a pin of a plate insert, by inserting its tip into the recess of the supporting element. Thereby the mat device may be mounted to the pins of the basket or may be spanned between pins of the basket.

In a preferred embodiment, the mat device has at least one mounting element for mounting the mat device on or in the basket, such that the mat device can be positioned in the basket in a desired orientation and/or the mat device is secured against sliding within the basket during its movement.

In a particularly preferred embodiment, the mat device can be clipped to at least one wire of the dishwasher basket.

In a further preferred embodiment, the mat device can simply be laid on the grid of the dishwasher basket.

Preferably, the ground area of the flat mat device is significantly smaller than the ground area of the basket where the mat device is to be placed. For example, the area is smaller than one third of the basket's area, preferentially smaller than one forth or one fifth of this area.

Reference is made in detail to a preferred embodiment of the invention, an example of which is illustrated in the accompanying drawings which show:

FIG. 1 a perspective view on a soft pad, and

Figure 2:
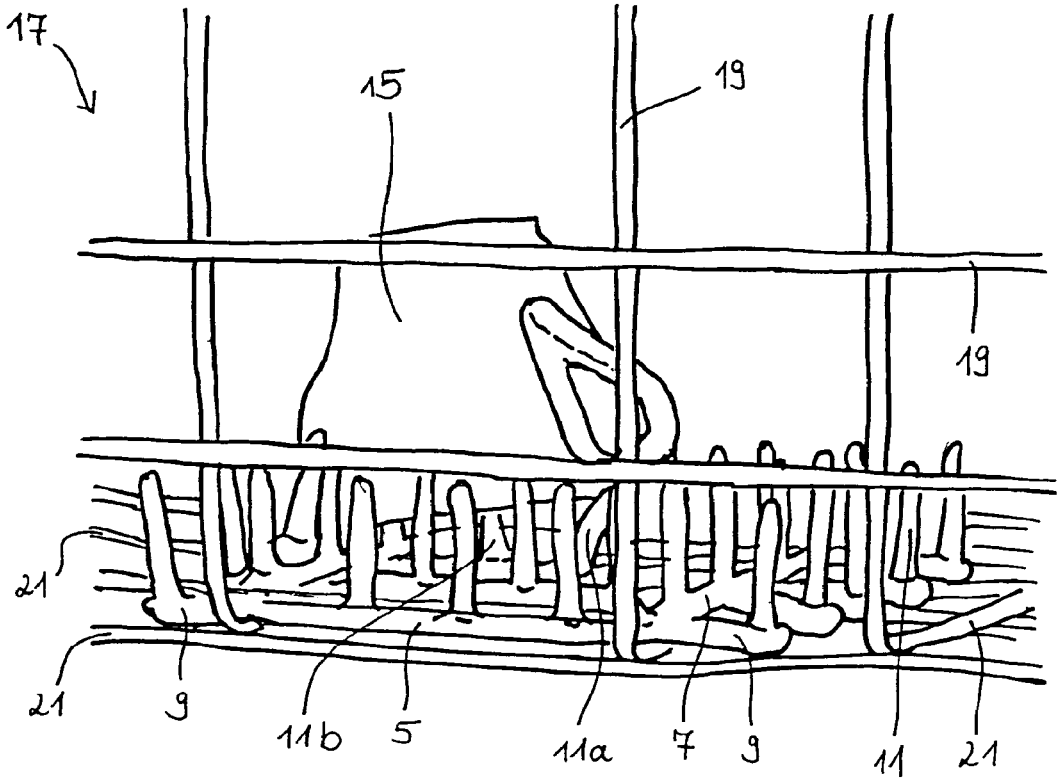

FIG. 2 the soft pad of FIG. 1 placed within a basket of a dishwashing machine.

FIG. 1 shows a perspective view on a soft pad 1 which is homogenously fabricated from a single elastic material by injection molding. The elastic material provides flexibility to adapt and change the basic form of the soft pad and results in an elastic surface of the soft pad in the areas where cutlery or dishes are placed. Further, the elastic material is resistant against the temperature and chemical conditions used during the dishwashing cycles. On the other hand, the soft pad has a residual rigidity, such that it at least partially stretches back to its base form as shown in FIG. 1, when no force is exerted to the soft pad 1.

The soft pad 1 comprises a base frame 3 formed of longitudinal bars 5 and cross bars 7, thereby forming an interlinked platform. The longitudinal bars 5 are extending beyond the cross bars 7 and are curved downward to bends 9. When placed in a basket, the downward bending bends 9 mesh with the grid of the basket, thereby laterally fixing the soft pad 1 within a basket 17 as shown in FIG. 2.

Perpendicular to the upper surface of the longitudinal bars 5 and cross bars 7 flexible fingers extend upward for receiving and supporting dishes and cutlery placed upon the soft pad 1.

FIG. 2 schematically shows the soft pad 1 of FIG. 1 placed within the basket 17 (only partially shown). The grid of the basket 17 is formed of side bars 19 and bottom bars 21. The soft pad 1 is placed here at the center front section of the upper basket 17. A cup 15 is placed on the soft pad 1 where the rim of the cup 15 is placed between the flexible fingers. Where the rim of the cup 15 runs over the center of fingers 11, the fingers are bent by the cup 15 and abut against the side or inner wall of the cup, as for example shown by fingers 11*a* and 11*b*.

The soft pad placed in the front section of the upper basket of a dishwashing machine provides a quick access zone for the user. Even if the washing machine's door is only partially opened and the upper basket is only partially drawn out of the tub, the user may place the dishes and cutlery even in a hastily manner upon the soft pad 1 without damage due to its soft and elastic bearing surface.

REFERENCE NUMERALS LIST

1 soft pad
3 base frame
5 longitudinal bar
7 cross bar
9 bend
11, 11*a*, 11*b* flexible finger
15 cup
17 basket
19 side bar
21 bottom bar

The invention claimed is:

1. Mat device adapted to be arranged in a basket (17) of a dishwashing machine, the mat device comprising a base structure (3), the base structure comprising a plurality of rigid supporting structures, which partially form a base of the mat device, linked together by flexible connection elements to provide the rigid supporting structures of the base structure (3) with a degree of flexibility relative to each other that allows the rigid supporting structures to be adjusted relative to each other during installation so the rigid supporting structures of the base structure can at least partially conform to a bottom of the basket (17), wherein the base structure (3) supports a plurality of flexible supporting elements (11) for receiving dishes (15) or cutlery to be supported on the base structure (3), the mat device further comprising at least one mounting element for mounting the mat device (1) in a manner that laterally fixes a position of the mat device on the bottom of the basket (17) of the dishwashing machine.

2. Mat device according to claim 1, wherein the supporting elements (11) comprise at least one of: pins, studs, fingers, plate inserts and cup inserts.

3. Mat device according to claim 1, wherein the supporting elements (11) are flexible, elastic, or both flexible and elastic.

4. Mat device according to claim 1, wherein the supporting elements (11) comprise at least one of: a soft material, a rigid material, and a semi-rigid material.

5. Mat device according to claim 1, wherein the supporting elements (11) comprise two components including at least a soft component.

6. Mat device according to claim 1, wherein at least a portion of the supporting elements (11) are at least partially hollow, and define a recess from below.

7. Mat device according to claim 1, wherein the base structure (3) has a web-shaped form.

8. Mat device according to claim 1, wherein the mat device (1) is at least partially formed of elastic material.

9. Mat device according to claim 1, wherein at least the base structure (3) comprises an elastic material.

10. Mat device according to claim 1, wherein at least one of the base structure (3) and the supporting elements (11) is composed of a flexible material or a semi-rigid material.

11. Mat device according to claim 10, wherein the flexible material is EPDM, or a soft plastic material.

12. Mat device according to claim 10, wherein the semi-rigid material is a thin metal wire or a plastic material that is coated with an elastic material.

13. Mat device according to claim 1, wherein the at least one mounting element comprises at least one detent for clipping the mat device to a wire of the basket (17) of the dishwashing machine.

14. Mat device according to claim 1, wherein at least one mounting element is arranged at the base structure (3) adapted to mount the mat device (1) on the bottom of a basket (17).

15. Mat device according to claim 1, wherein a width of the mat device (1) is less than 30 cm.

16. Mat device according to claim 1, wherein a depth of the mat device (1) is less than 30 cm.

17. Dishwashing machine comprising:

a tub in which a washing operation is performed;

an adjustable door for restricting access to an interior of the tub;

a basket (17) that is adjustable to be drawn out of the tub to facilitate loading and unloading of dishes washed by the dishwashing machine, wherein the basket comprises a mat device (1) according to claim 2 supported within a front section of the basket.

18. Mat device according to claim 1, wherein the base structure forms a bottom surface of the mat and, when flexed, causes movement of a first one of the rigid supporting structures relative to a second one of the rigid supporting structures.

* * * * *